US006668741B1

(12) United States Patent
Curtiss

(10) Patent No.: US 6,668,741 B1
(45) Date of Patent: Dec. 30, 2003

(54) HIGH PERFORMANCE SAILING CRAFT

(76) Inventor: Steve Curtiss, 204 Pasa Robles Ave., Los Altos, CA (US) 94022

( * ) Notice: Subject to any disclaimer, the term of this patent is extended or adjusted under 35 U.S.C. 154(b) by 0 days.

(21) Appl. No.: 09/733,514

(22) Filed: Dec. 7, 2000

(51) Int. Cl.[7] ..... B63B 35/00

(52) U.S. Cl. ..... 114/39.21; 114/102.29; 114/108

(58) Field of Search ..... 114/39.21, 39.29, 114/39.32, 39.28, 90, 91, 92, 93, 102–11, 102.1, 102.29, 105, 108

(56) References Cited

U.S. PATENT DOCUMENTS

| | | | | | |
|---|---|---|---|---|---|
| 655,234 | A | | 8/1900 | Howe et al. | |
| 1,613,890 | A | * | 1/1927 | Herreshoff | 114/39.31 |
| 1,625,579 | A | | 4/1927 | Walters | |
| 2,724,356 | A | | 11/1955 | Szakacs | |
| 2,858,788 | A | | 11/1958 | Lyman | |
| 3,195,494 | A | | 7/1965 | Robin | |
| 3,537,417 | A | | 11/1970 | Beckner | |
| 3,693,571 | A | * | 9/1972 | Hiscock | 114/39.29 |
| 3,707,935 | A | * | 1/1973 | Rachie | 114/39.1 |
| 3,800,728 | A | * | 4/1974 | Dowling | 114/105 |
| 3,802,373 | A | * | 4/1974 | Lagerquist | 114/105 |
| 3,851,608 | A | * | 12/1974 | Stearn | 114/105 |
| 3,851,609 | A | * | 12/1974 | Stearn | 114/105 |
| 3,902,443 | A | | 9/1975 | McDougall | |
| 3,972,300 | A | * | 8/1976 | Adamski | 114/39.32 |
| 3,985,090 | A | * | 10/1976 | Rineman | 114/39.1 |
| 4,194,458 | A | | 3/1980 | Messing | |
| 4,598,659 | A | | 7/1986 | Chinnery | |
| 4,641,594 | A | | 2/1987 | Birkett | |
| 4,646,669 | A | | 3/1987 | Frank | |
| 4,667,615 | A | | 5/1987 | Marker | |
| 4,682,557 | A | * | 7/1987 | Magruder et al. | 114/39.1 |
| 4,720,280 | A | | 1/1988 | Hufnagl et al. | |
| 4,752,261 | A | | 6/1988 | Rosello Zoya | |
| 4,753,183 | A | | 6/1988 | Jira | |
| 4,838,196 | A | | 6/1989 | Ingram | |
| 4,852,507 | A | | 8/1989 | Ryon et al. | |
| 4,926,774 | A | | 5/1990 | Winner | |
| 4,998,494 | A | | 3/1991 | Deutsch | |
| 5,001,999 | A | | 3/1991 | Morrelli | |
| 5,007,361 | A | | 4/1991 | Swanstrom | |
| 5,038,698 | A | | 8/1991 | Winner | |
| 5,054,411 | A | * | 10/1991 | Nelson | 114/39.1 |
| 5,176,091 | A | | 1/1993 | Burnham, II | |
| 5,272,996 | A | * | 12/1993 | Drexler | 114/103 |
| 5,377,607 | A | | 1/1995 | Ross | |
| 5,396,856 | A | * | 3/1995 | Bourrieres | 114/39.2 |
| 5,463,970 | A | * | 11/1995 | Hartlmeier et al. | 114/105 |
| 5,884,575 | A | * | 3/1999 | Talasimov | 114/39.1 |
| 6,032,599 | A | * | 3/2000 | Leboe | 114/39.12 |

OTHER PUBLICATIONS

Philip C. Bolger, Boats with an Open Mind 75 Unconventional Designs and Concepts, 1994, Chapter 30, pp. 149–155.

* cited by examiner

*Primary Examiner*—S. Joseph Morano
*Assistant Examiner*—Lars A. Olson
(74) *Attorney, Agent, or Firm*—Edward S. Wright

(57) ABSTRACT

Sailing craft having a hull, a seat disposed toward the rear of the hull and largely outboard of the hull, a mast affixed directly to the seat so that heeling forces applied to the mast are counterbalanced by the weight of a sailor primarily through the seat and not through the hull, a rotatably mounted stay extending between the top of the mast and a forward portion of the hull, a boom affixed to the stay, a sail mounted on the stay, and a rigid control rod connected to the boom for swinging the sail about the axis of the stay.

25 Claims, 6 Drawing Sheets

HIGH PERFORMANCE SAILING CRAFT

This invention pertains generally to water craft and, more particularly, to a high performance sailing craft.

For high performance, a small sailing craft should generally have as little wetted hull area and as much sail area as possible. The hull area must be sufficient to support the craft, and the maximum sail area is limited by forces which can be controlled by the weight of a sailor.

Windsurfers, with non-rigid mast connections toward the front of their hulls, are very fast and fun to sail because they have small hulls and large sail forces. However, they are also very tiring because the sailor himself is the connection between the sail and the hull, and he must continuously endure forces such as the heel torque, the drive torque and the main sheet forces.

Small sailboats which have a rigid forward mast can also attain good sailing speeds, but in order to transfer the mast forces, the hull must be have substantial depth and stiffness. Such sailboats are larger than windsurfers and are more difficult to store, set up and transport.

It is in general an object of the invention to provide a new and improved sailing craft.

Another object of the invention is to provide a sailing craft of the above character which overcomes the limitations and disadvantages of the prior art and is capable of high performance sailing.

These and other objects are achieved in accordance with the invention by providing a sailing craft which has a hull, a seat disposed toward the rear of the hull and largely outboard of the hull, a mast affixed directly to the seat so that heeling forces applied to the mast are counterbalanced by the weight of a sailor primarily through the seat and not through the hull, a rotatably mounted stay extending between the top of the mast and a forward portion of the hull, a boom affixed to the stay, a sail mounted on the stay, and a rigid control rod connected to the boom for swinging the sail about the axis of the stay.

Figure 1:
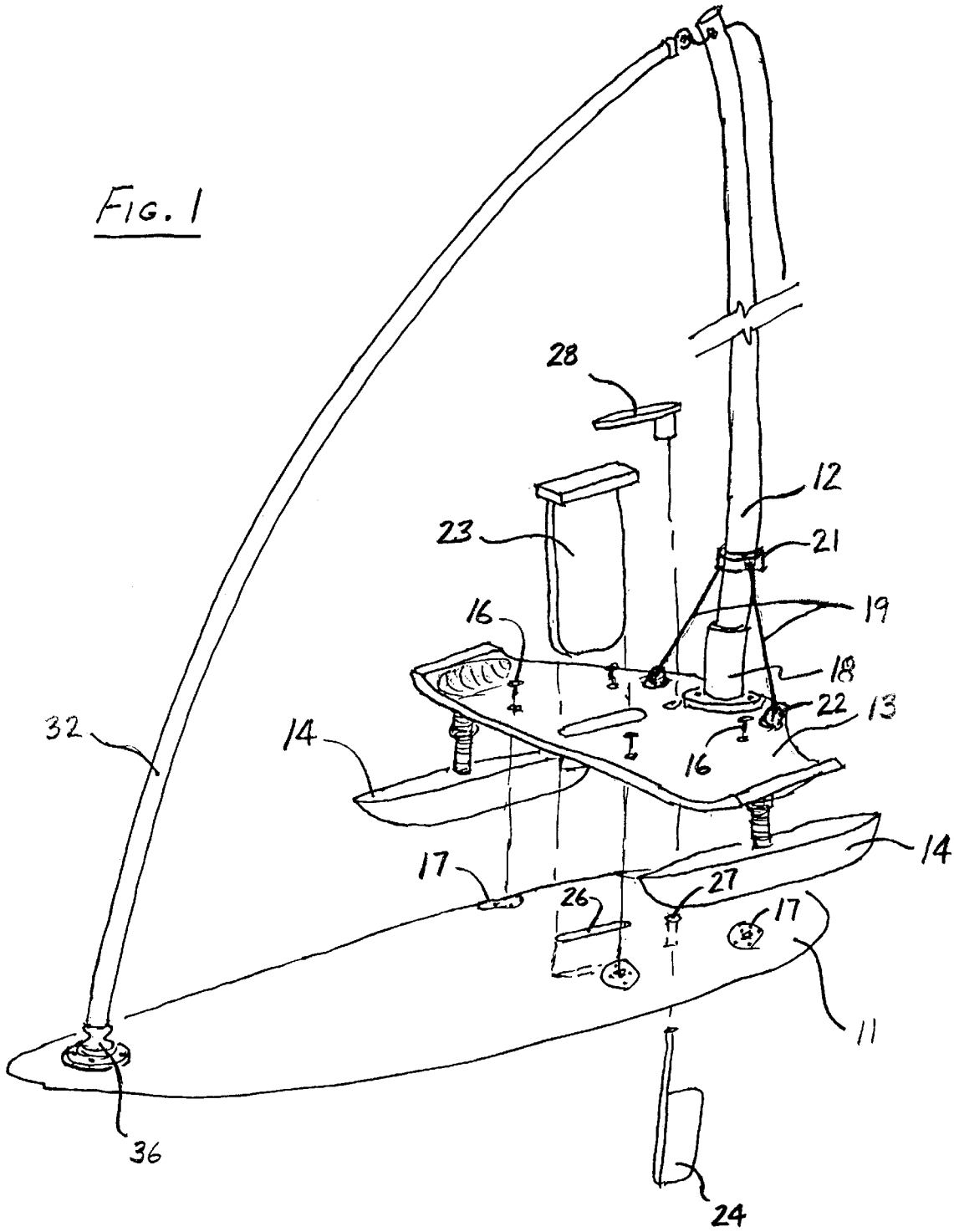
FIG. 1 is an exploded perspective view of one embodiment of a sail craft incorporating the invention, with the sail and boom removed for clarity of illustration.

As illustrated in the drawings, the sailing craft has a hull 11 with a mast 12 located toward the rear of the hull. Rather than being connected directly to the hull, the mast is affixed to a seat 13 which is mounted on top of the hull, with outboard portions of the seat extending laterally beyond the sides of the hull so that a sailor sitting on the seat can hike out on them. In the embodiment illustrated, pontoons 14 are attached to the under side of the seat on either side of the hull to provide additional stability, but they can be omitted, if desired.

Seat 13 is a rigid structure which is affixed to the hull by screws 16 which are received in reinforced pads 17 on the hull. The seat can be fabricated of any suitable material such as wood, fiberglass, or another rigid plastic.

Mast 12 is mounted to the seat by means of a base 18 which is affixed to the seat by bolts or other suitable means, with a pair of shrouds 19 extending between the mast and the seat to provide addition rigidity. In the embodiment illustrated, the shrouds are connected to the mast by a ring 21 which is clamped onto the mast and to rings 22 which are affixed to the seat. If desired, the shrouds can be tensioned by turnbuckles (not shown) or by other suitable means.

With the mast affixed to the seat, rather than to the hull, the majority of the heeling forces and other forces produced by the sail bypass the hull and are counterbalanced by the weight of the sailor directly through the seat. Since it does not have to transfer those forces, the hull does not have to be rigid, and it can be small, extremely lightweight, and inexpensive to manufacture. It can, for example, be inflatable, it can be made of a flexible foam, or it can be formed in a single pour rotomolding process.

The centerboard 23 and rudder 24 are also attached to the rigid seat structure. They pass through openings 26, 27 in the hull, with a handle 28 affixed to the rudder above the seat.

The sail 31 is mounted on a stay 32 which extends between the top of the mast and a forward portion of the hull. The stay is thus inclined forwardly and downwardly, and the luff of the sail is hemmed to form a pocket 33 in which the stay is received.

The stay is mounted for rotation about its axis, with the lower end of the stay being connected to the hull by a flexible connector 36 and the upper end being connected to the mast by a line 37 and a fitting 38.

Connector 36 includes a base 39 and a flexible body 41 with pivot pins 42, 43 extending from the upper and lower ends of the flexible body. The base is affixed to the hull by rivets 44, and the body is rotatively mounted on the base by pivot pin 43. The body is made of rubber and can flex freely in all directions. Pivot pin 42 is rotatively received in a socket 46 in the lower end of the stay, with a detent assembly 47 retaining the pin in the socket. The detent assembly comprises a pin 48 which is mounted on a flat spring 49 affixed to the stay and received in a groove 51 near the upper end of pivot pin 42.

In addition to permitting the stay to rotate freely, connector 36 also permits it to be folded over for raising and lowering of the sail. Moreover, with the flexible connection at the bottom of the stay, there is no transfer of torque through that connection between the sail and the hull.

Connector 38 comprises a bushing 53 which is mounted in the upper end of the stay, and a ring 54 with a shank 54*a* which is rotatively mounted in the bushing. Line 37 passes through an opening 56 in the upper portion of the mast and is tied to the ring. This line is pulled from below to raise and lower the sail assembly.

The sail is held up on the stay by a strap 58 which loops around a collar 59 that slips over the upper end of the stay. The collar bears against the heads of a ring of screws 61 which are driven into the mast to limit its downward movement.

Downhaul stretch for the sail is provided by a line 63 which is trained about a pulley 64 at the lower end of the stay. The pulley is mounted between flanges 66 which extend from the stay and are rigidly connected to it. The line is tied off in a hole 67 in one of the flanges and passed through a grommet 68 in the sail, then around the pulley and back through the grommet. By pulling on the free end of the line, the sailor can stretch the sail tightly along the stay.

Figure 5:
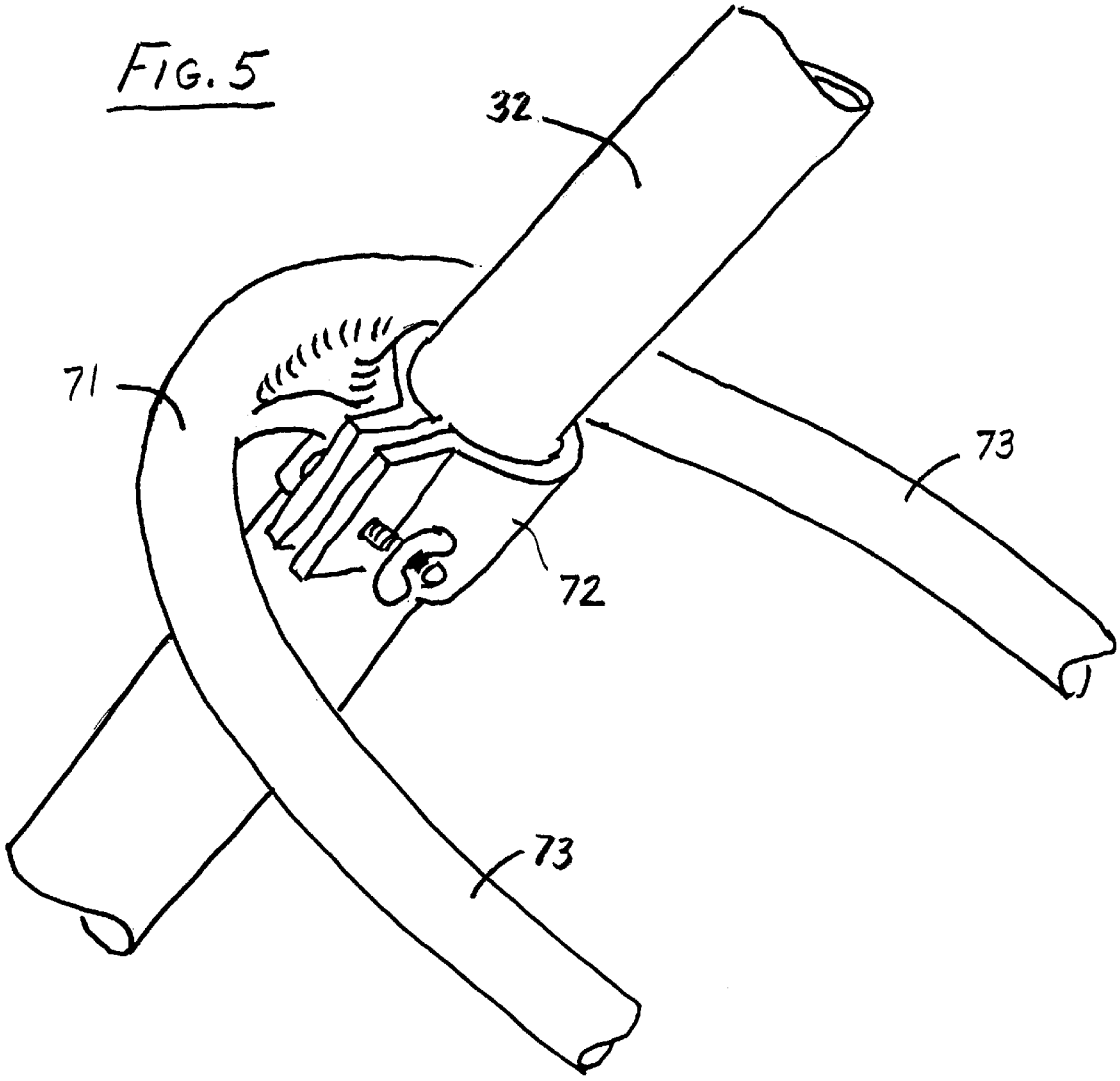
FIG. 5 is an enlarged, fragmentary perspective view illustrating the connection between the boom and the stay in the embodiment of FIG. 1.
Figure 6:
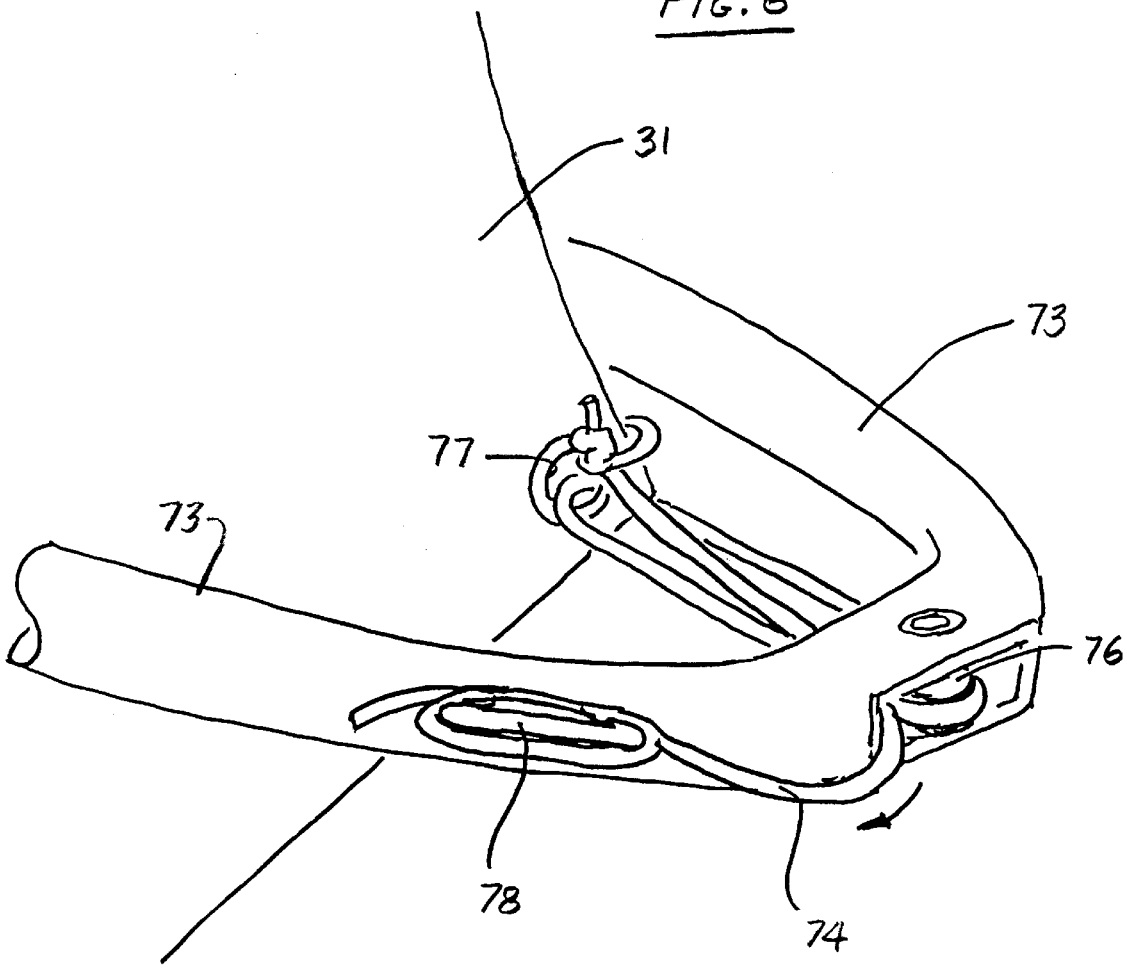
FIG. 6 is an enlarged, fragmentary perspective view illustrating the connection between the sail and the boom in the embodiment of FIG. 1.

A boom 71 is affixed to the stay by means of a clamp 72, as best seen in FIG. 5. The boom is in the nature of a wishbone or oval shaped boom, with arms 73 that bow outwardly on either side of the sail. The leech of the sail is secured to the boom by a line 74 which trained about a pulley 76 at the rear of the boom. This line is tied off at a grommet 77 in the sail, then trained about the pulley, and passed back through the grommet. Pulling this line provides outhaul stretch to the sail, following which it is tied off to a cleat 78.

The rear mast and pivoting stay have been found to make it surprisingly easy to maneuver the boat. Turning and handling are extremely easy, unlike either a windsurfer or a conventional sailboat, and even an outside jibe, where the boom passes out and over the bow, is quick and easy to do. Because the stay is tilted, gravity provides a restoring force which tends to return the sail to a point where that force balances the wind, and the boat continues to have forward motion and rudder control even if the sail is released.

Figure 2:
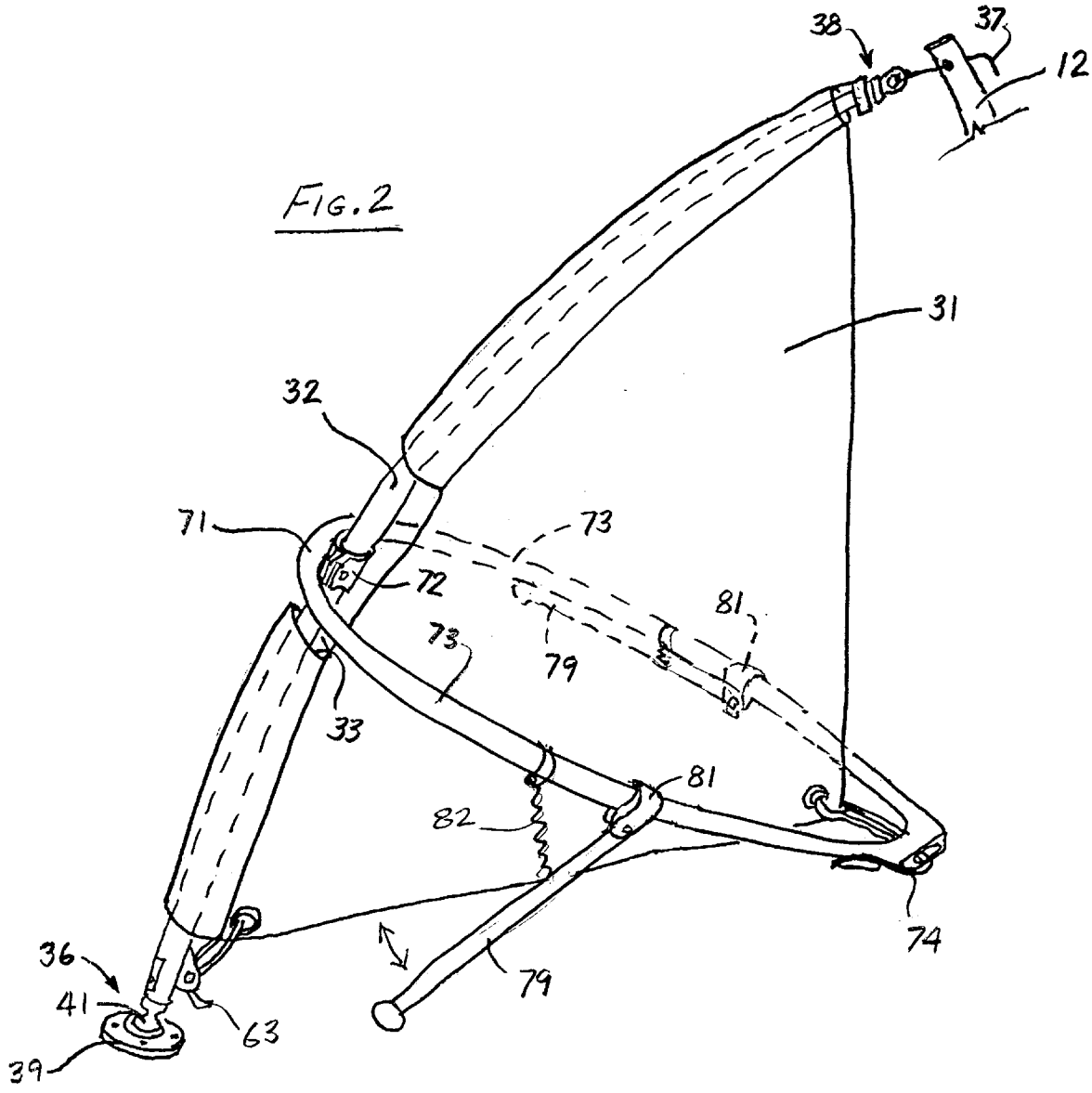
FIG. 2 is a perspective view of the sail and boom assembly in the embodiment of FIG. 1.
Figure 3:
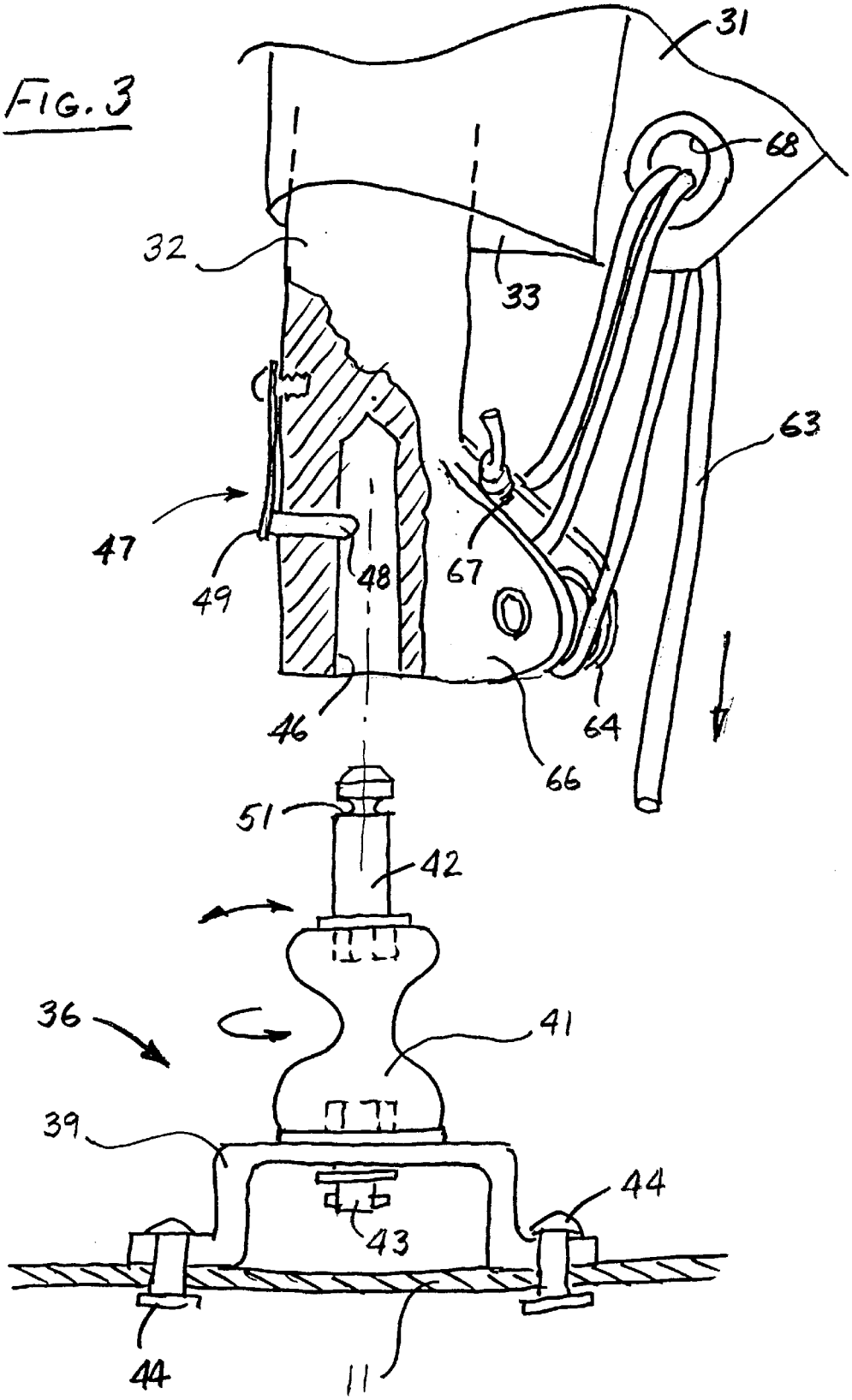
FIG. 3 is an enlarged, fragmentary perspective view, partly exploded, illustrating the connection between the stay and the hull in the embodiment of FIG. 1.
Figure 4:
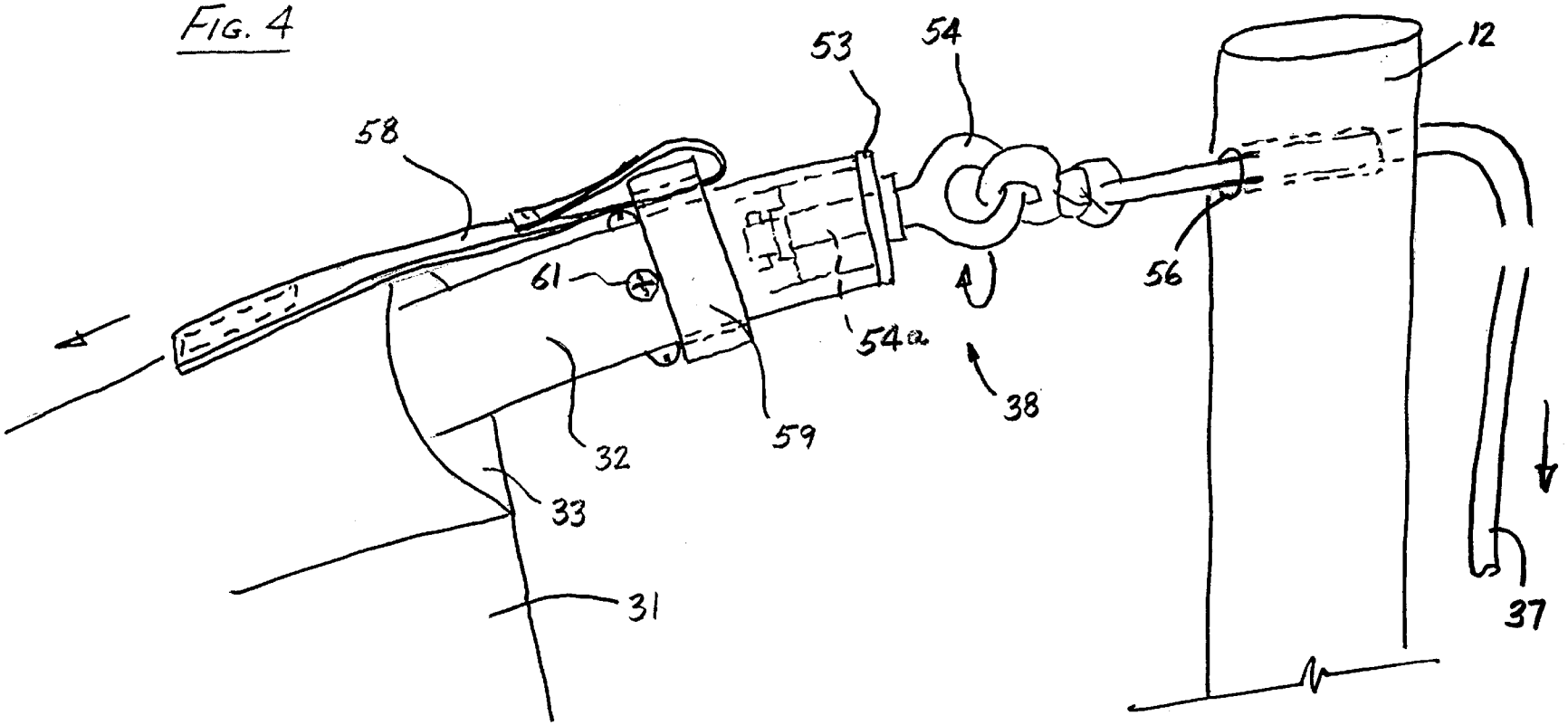
FIG. 4 is an enlarged, fragmentary perspective view illustrating the connection between the stay and the mast in the embodiment of FIG. 1.

Referring again to FIG. 2, rigid control rods 79 are connected to the arms 73 of the boom on either side of the sail. In the embodiment illustrated, the control rods are pivotally mounted to brackets 81 which are clamped to the arms of the boom for movement between extended and retracted positions. The control rods are urged toward their retracted positions by return springs 82 which can be in the form of elastic cords or other suitable means. The rods are held against the arms in their retracted positions by Velcro fasteners (not shown). In their extended positions, the control rods can be grasped by a sailor who can either push on them or pull on them to swing the sail about the axis of the stay and control the angle between the boom and the centerline of the boat.

The rigid control rods give the sailor a better sense of the wind behavior and quicker control of the boom than he would have with conventional boom lines. They also give him the ability to push the boom as well as pulling it, which results in far better balance and overall sailing stability.

If desired, a single control rod which extends to the rear of the boom can be employed instead of the two rods on opposite sides of the sail.

The invention has a number of important features and advantages. It provides a sailing craft which has a very small, lightweight hull but which also has the ability to easily support and control a sail with sufficient force to provide high performance sailing. It can be manufactured either as a custom boat design, or as an add-on attachment to another watercraft such as a kayak, a windsurfer, or a surfboard.

It is apparent from the foregoing that a new and improved sailing craft has been provided. While only one presently preferred embodiment has been described in detail, as will be apparent to those familiar with the art, certain changes and modifications can be made without departing from the scope of the invention as defined by the following claims.

What is claimed is:

1. A sailing craft comprising a longitudinally extending hull, a seat disposed toward the rear of the hull and largely outboard of the hull, a mast positioned directly above the longitudinal axis of the hull and affixed directly to the rear portion of the seat so that heeling forces applied to the mast are counterbalanced by the weight of a sailor primarily through the seat and not through the hull, a rotatably mounted stay extending between the top of the mast and a forward portion of the hull, a boom affixed to the stay, a sail mounted on the stay and attached to the boom, and a rigid control rod connected to the boom for swinging the sail, the stay and the boom as a unit about an axis extending between the top of the mast and the forward portion of the hull.

2. The sailing craft of claim 1 further including a pair of shrouds extending between the mast and the seat for transferring forces between the mast and the seat.

3. The sailing craft of claim 1 further including a pair of pontoons at the outboard ends of the seat.

4. The sailing craft of claim 1 wherein the stay is connected to the hull by a flexible connector that permits the stay to be lowered.

5. The sailing craft of claim 1 wherein the boom is a wishbone boom with arms on both sides of the sail, with a separate control rod connected to the arm on each side of the sail.

6. The sailing craft of claim 5 wherein the control rods are pivotally connected to the arms of the boom for movement between extended and retracted positions.

7. In a sailing craft: a single longitudinally extending hull, a seat at the rear of the hull with portions of the seat extending outboard of the hull to permit hiking out by a sailor, a mast positioned directly above the longitudinal centerline of the hull and affixed directly to the rear portion of the seat so that heeling forces applied to the mast are counterbalanced by the weight of a sailor primarily through the seat and not through the hull, and a sail attached to the mast.

8. The sailing craft of claim 7 wherein the sail is mounted on a stay which extends downwardly and forwardly between the top of the mast and the hull.

9. The sailing craft of claim 8 including means rotatively connecting the stay to the mast and to the hull so that the stay is free to pivot about an inclined axis between the top of the mast and the hull.

10. The sailing craft of claim 9 further including a boom affixed to the stay, and a control rod connected to the boom for swinging the sail about the inclined axis.

11. In a sailing craft: a hull, an upstanding mast toward the rear of the hull, a downwardly and forwardly inclined stay extending between the top of the mast and the hull, pivots rotatively connecting the stay to the mast and to the hull so that the stay is free to pivot about an axis of rotation which passes through the pivots, a boom affixed to the stay, and a sail mounted on the under side of the stay and attached to the boom such that the sail, the stay and the boom are free to rotate as a unit about the axis of rotation.

12. The sailing craft of claim 11 further including a rigid control rod connected directly to the boom for swinging the sail about the axis of rotation.

13. The sailing craft of claim 11 wherein the pivot rotatively connecting the stay to the mast comprises a rotary fitting at the upper end of the stay and a line attached to the fitting.

14. The sailing craft of claim 11 wherein the pivot rotatively connecting the stay to the hull comprises a flexible connector which is mounted to the hull and has a pivot pin rotatively received in a socket in the lower end of the stay.

15. In a sailing craft: a hull, an upstanding mast toward the rear or the hull, a downwardly and forwardly inclined stay extending between the top of the mast and the hurl, pivots rotatively connecting the stay to the mast and to the hull so that the stay is free to pivot about an axis which extends through the pivots, a boom having a pair of outwardly bowed arms affixed to the stay, a sail mounted on the under side of the stay between the arms of the boom with the luff of the sail connected to tho stay and the leech connected to the boom, and rigid control rods connected to the arms of the boom for swinging the sail around the axis.

16. The sailing craft of claim 15 wherein the control rods are pivotally connected to the arms of the boom for movement between extended and retracted positions.

17. The sailing craft of claim 16 further including means yieldably urging the control rods toward their retracted position.

18. In a sailing craft: a hull, an upstanding mast toward the rear of the hull, a bowed stay extending between the top of the mast and a forward portion of the hull, pivots rotatively connecting the stay to the mast and to the hull such that the stay is free to rotate about an axis passing through the pivots, a boom affixed to the stay, and a sail having its luff attached to the stay and its leech secured to the boom such that the sail, the stay and the boom are free to rotate as a unit about the axis.

19. In a sailing craft: a centrally disposed, longitudinally extending hull, a seat toward the rear of the hull with portions of the seat extending outboard of the hull to permit hiking out by a sailor, a mast positioned directly above the longitudinal centerline of the centrally disposed hull and affixed directly to a rear portion of the seat so that heeling forces applied to the mast are counterbalanced by the weight of a sailor primarily through the seat and not through the hull, and a sail attached to the mast.

20. The sailing craft of claim 19 further including a pair of pontoons positioned toward the outboard ends of the seat.

21. A sailing craft comprising a longitudinally extending hull, a pair of outboard stabilizers positioned on opposite sides of the hull, a seat which is attached to a rear portion of the hull, a mast positioned directly above the longitudinal centerline of the hull and affixed directly to the rear portion of the seat so that heeling forces applied to the mast are counterbalanced by the weight of a sailor primarily through the seat and not through the central hull, and a sail attached to the mast.

22. The sailing craft of claim 21 wherein the outboard stabilizers are pontoons.

23. The sailing craft of claim 21 wherein the hull is substantially longer than the outboard stabilizers.

24. The sailing craft of claim 21 wherein the outboard stabilizers are positioned toward the rear of the hull.

25. The sailing craft of claim 21 wherein the outboard stabilizers are attached to outboard portions of the seat.

* * * * *